US009239214B2

(12) United States Patent
Smith

(10) Patent No.: US 9,239,214 B2
(45) Date of Patent: Jan. 19, 2016

(54) FLOATING BARRIER

(75) Inventor: Ronald Smith, Shropshire (GB)

(73) Assignee: BIRMINGHAM BARBED TAPE LTD., Worcestershire (GB)

( * ) Notice: Subject to any disclaimer, the term of this patent is extended or adjusted under 35 U.S.C. 154(b) by 163 days.

(21) Appl. No.: 14/110,313

(22) PCT Filed: Apr. 5, 2012

(86) PCT No.: PCT/IB2012/000702

§ 371 (c)(1),
(2), (4) Date: Oct. 28, 2013

(87) PCT Pub. No.: WO2012/137061

PCT Pub. Date: Oct. 11, 2012

(65) Prior Publication Data

US 2014/0306170 A1 Oct. 16, 2014

(30) Foreign Application Priority Data

Apr. 7, 2011 (ZA) ..... 2011/02556

(51) Int. Cl.

| | |
|---|---|
| ***A01K 3/00*** | (2006.01) |
| ***E01F 7/00*** | (2006.01) |
| ***F41H 11/05*** | (2006.01) |

(52) U.S. Cl.

CPC ..... *F41H 11/05* (2013.01)

(58) Field of Classification Search

USPC ..... 256/1, 13, 24, 73; 405/21, 26, 35, 63, 405/64

See application file for complete search history.

(56) References Cited

U.S. PATENT DOCUMENTS

| | | | | |
|---|---|---|---|---|
| 2,146,105 | A * | 2/1939 | Baker | 119/220 |
| 3,441,962 | A * | 5/1969 | Williams | 441/6 |
| 3,969,901 | A * | 7/1976 | Matsudaira et al. | 405/23 |
| 5,429,452 | A * | 7/1995 | Frost | 405/26 |
| 5,671,584 | A * | 9/1997 | Mueller | 52/780 |
| 6,033,151 | A * | 3/2000 | Tsou | 405/219 |
| 7,140,599 | B1 * | 11/2006 | Spink | 256/13 |
| 7,390,141 | B2 * | 6/2008 | Rytand | 405/23 |
| 7,527,453 | B2 * | 5/2009 | Smith | 405/26 |
| 7,575,396 | B2 * | 8/2009 | Cederlund | 405/27 |
| D616,779 | S * | 6/2010 | Cochrane | D10/107 |
| 7,862,258 | B2 * | 1/2011 | Meyers et al. | 405/215 |
| 2003/0051652 | A1 | 3/2003 | Metherell et al. | |
| 2005/0191129 | A1 | 9/2005 | Yodock, III et al. | |
| 2009/0036008 | A1 * | 2/2009 | Watkins et al. | 441/1 |

FOREIGN PATENT DOCUMENTS

| | | |
|---|---|---|
| WO | 2009/152533 | 12/2009 |

* cited by examiner

*Primary Examiner* — Gregory Binda
*Assistant Examiner* — Nahid Amiri
(74) *Attorney, Agent, or Firm* — Tutunjian & Bitetto, P.C.

(57) ABSTRACT

A floating barrier which includes a number of buoyant bodies (12) which are fixed to an axle (36) from which extend a downwardly directed counterweight (124) and upwardly directed supports (130) to which transverse chains or cables are fixed.

8 Claims, 6 Drawing Sheets

FLOATING BARRIER

CROSS REFERENCE TO RELATED APPLICATIONS

This application claims priority to Republic of South Africa Application No. 2011/02556 filed on Apr. 7, 2011 and 371 PCT/IB12/00702, filed on Apr. 5, 2012.

BACKGROUND OF THE INVENTION

This invention relates to the provision of a barrier on a body of water e.g. at sea, in a dam or river, in an estuary or the like.

There is a need for certain strategic installations, whether permanent or temporary, land-based or floating, to be protected against intrusions, attacks and, more generally, against unauthorised access. For example an installation on land, close to a beach or floating in water can be attacked by assailants in a relatively small boat. Although it is difficult to protect this type of installation against all water-based attacks a requirement exists for a security barrier which can provide, at least, a substantial degree of protection, particularly against attacks which are launched using relatively small water vessels.

US 2005191129 discloses a barrier with an elongate axle and buoyant bodies mounted at spaced locations to the axle. A counterweight is attached to the axle and upwardly extending supports at spaced locations on the axle, support a transversely extending flexible member. The barrier has an "integral" type of construction which, in the applicant's view, does not necessarily provide comprehensive protection in that the barrier can be overcome by the vessel which is aimed at the barrier at a high speed. An object of the present invention is to address, in a more effective manner, this type of situation.

SUMMARY OF THE INVENTION

The invention provides a barrier which includes an elongate axle, at least first and second buoyant bodies mounted at spaced locations to the axle, at least one counterweight which is attached to the axle, at least two upwardly extending supports mounted at spaced locations to the axle, and at least one elongate flexible retaining member attached to and extending between the supports wherein the counterweight includes a mass, and at least two of the elongate members with respective first ends are attached to the axle at spaced locations. The mass may be attached to, and positioned between, respective second ends of the two elongate members.

The mass may be separately formed and attached in any suitable way to the axle.

Depending on the extent of deterrence required, safety constraints and other factors each buoyant body may be substantially smooth on an outer surface, or include a plurality of deterrent formations on an outer surface.

The first and second buoyant bodies may be mounted at spaced locations to the axle between the elongate members, and the barrier may include third and fourth buoyant bodies mounted to the axle near respective opposed ends of the axle. This is a preferred construction, but other arrangements are possible.

Each buoyant body may be of any suitable shape e.g. cylindrical or spherical. The buoyant body may be formed from two separately constructed halves, e.g. hemispheres, which are interconnected to form the body e.g. a sphere The axle may extend between interconnected halves of the body.

Mounting components attached to the axle may allow for rotation of the axle about a longitudinal axis. Each mounting component may be of any suitable kind and may include a shackle or joint, in the nature of a universal coupling, which allows the axle to rotate and to move transversely, to a limited extent, relative to the axis.

Each buoyant body may be rotatable about, and relative to, the axle. Alternatively each body is fixed to the axle so that it is rotatable together with the axle.

The elongate flexible retaining member may be a cable or chain.

The invention further extends to a barrier assembly which includes a plurality of barriers, each barrier being of the aforementioned kind, wherein the barriers are connected to one another in an elongate array.

It is possible to increase the degree of security which is offered by a floating barrier by interconnecting a plurality of barriers, each barrier being of the aforementioned kind, in a two-dimensional array (viewed in plan).

BRIEF DESCRIPTION OF THE DRAWINGS

The invention is further described by way of example with reference to the accompanying drawings in which.

DESCRIPTION OF PREFERRED EMBODIMENT

Figure 1:
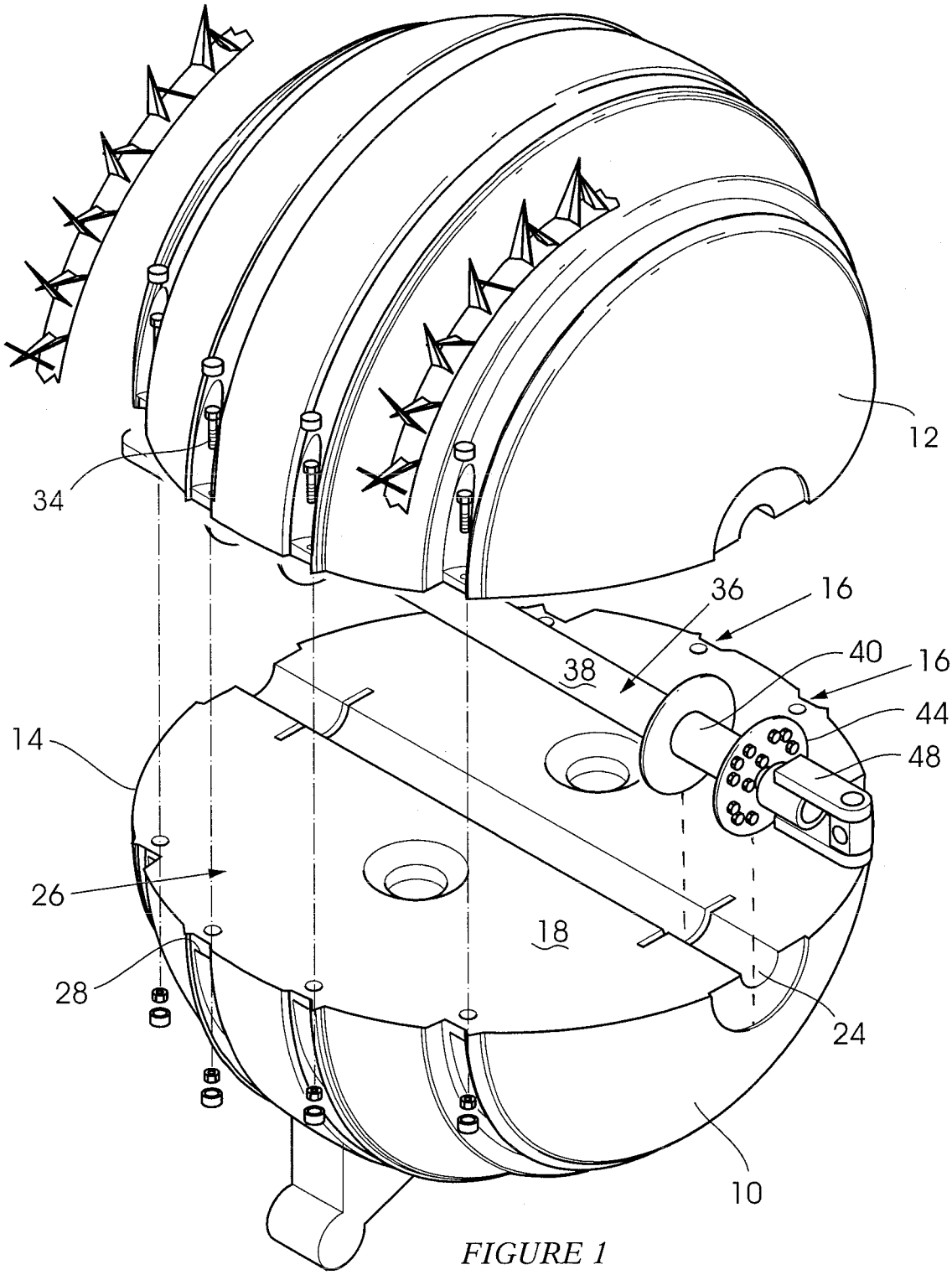
FIG. 1 illustrates half sections of a buoyant body.

FIG. 1 of the accompanying drawings illustrates first and second half sections 10 and 12 respectively, of a buoyant body. The half sections are, for all practical purposes, substantially identical. Thus the construction of the half section 10, only, is described.

The half section 10 includes a moulded hemispherical shell 14 which is formed from a suitable plastics material. The shell has a number of channels 16 which extend over its outer surface. An interior of the shell is filled with a closed cell marine foam 18.

An elongate channel 24 extends diametrically, in the foam, across a flat surface 26 of the half section. A number of flanges 28, integral with the shell 14, are located in respective channels at a perimeter of the flat surface 26.

Figure 2:
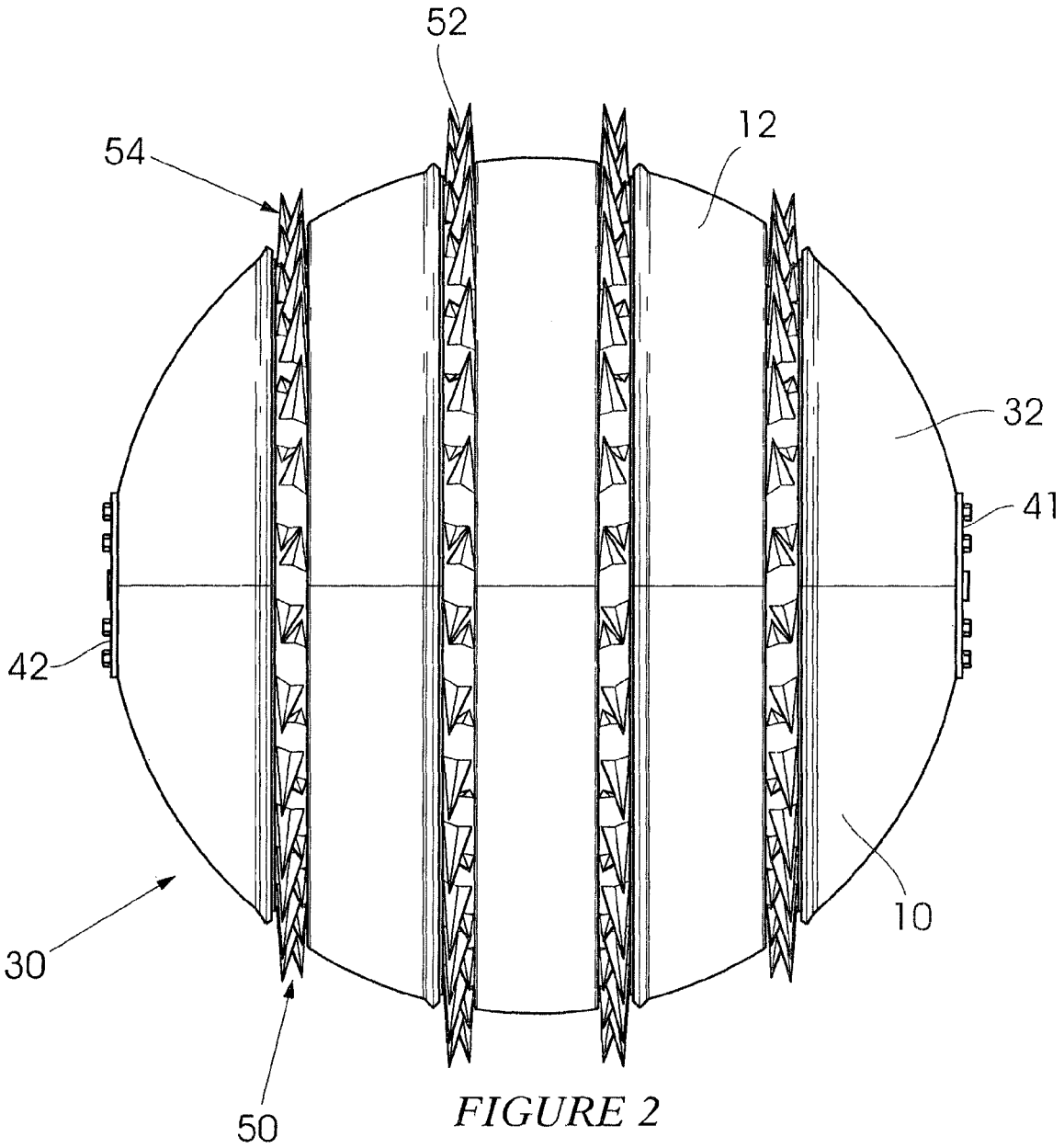
FIGS. 2, 3 and 4 are front, side and perspective views respectively, of an assembled buoyant body.
Figure 3:
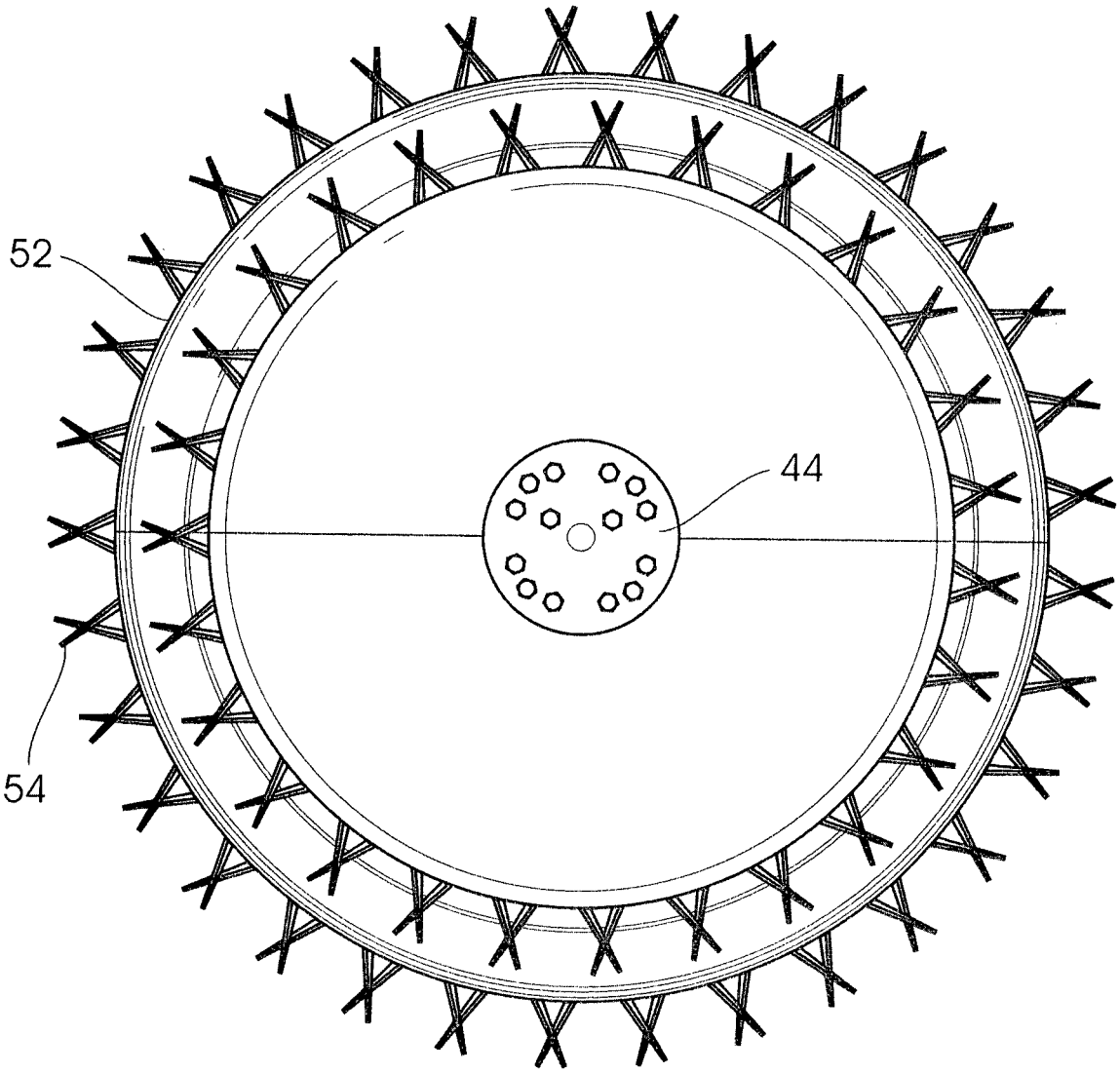
Figure 4:
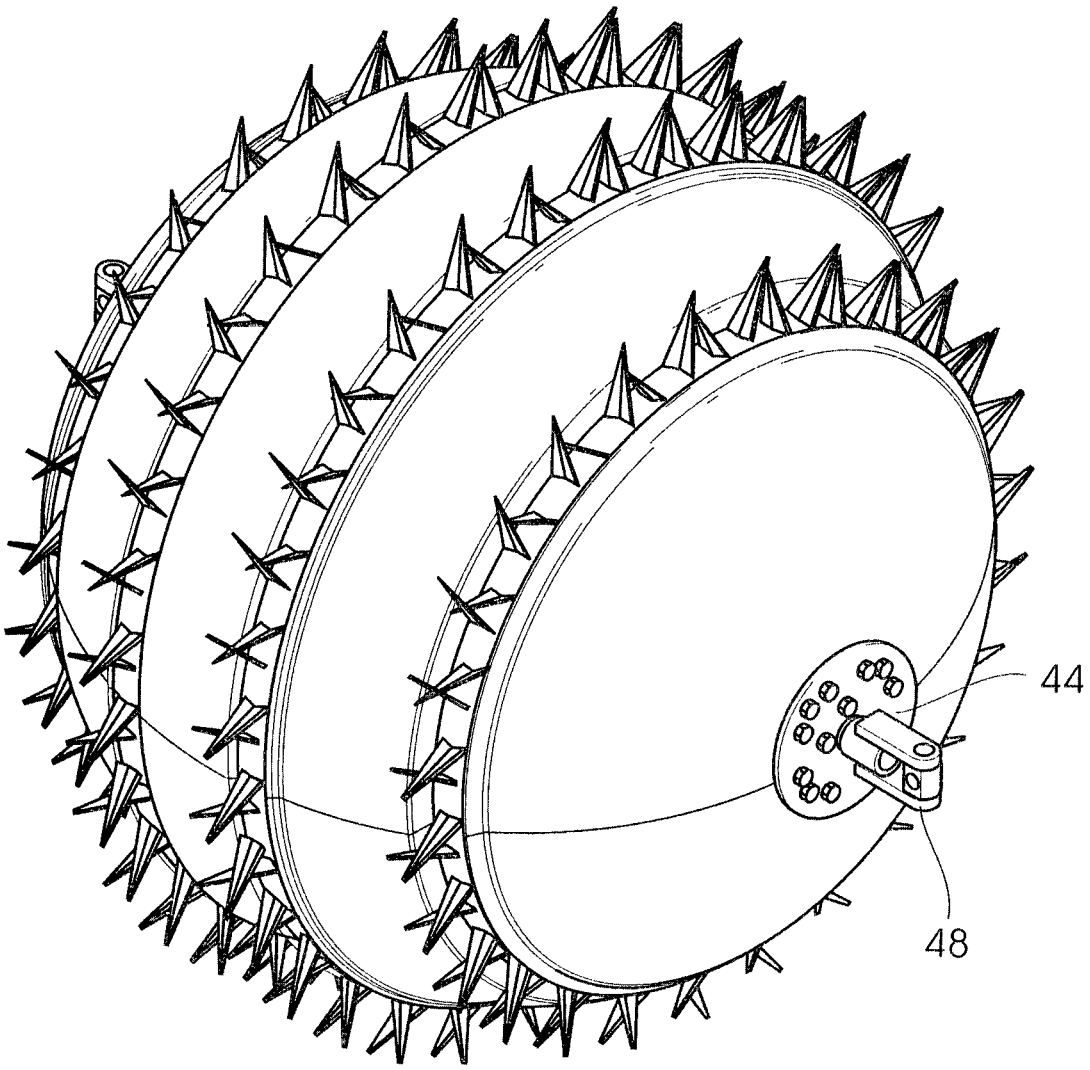

FIGS. 2 to 4 are front, side and perspective views, respectively, of a buoyant spherical body 32 which is formed by interconnecting the half sections 10 and 12 to each other. Bolts 34 are passed through registering holes in the flanges 28 and the half sections are thereby firmly secured to each other. A portion of an axle 36 (see FIG. 1) is previously positioned in the registering channels 24 in the two half sections. The axle includes an outer tube 38 through which extends a shaft 40. At opposed ends of the half sections the tube has respective flanges 42 and 44 which are bolted to the assembled half sections.

In another form of the invention each buoyant body is not spherical, as shown, but instead is circular cylindrical. Each body could have any other suitable shape.

The channels 16 in the two half sections 10 and 12 form circular recesses 50. Circumferentially extending bands 52 are then positioned in the recesses 50 in an outer surface of the spherical body 32. These bands carry outwardly projecting spike or deterrent formations 54. The bands are formed in semi-circular half sections which are bolted together. In this way, a substantial force is exerted on the two half sections which helps to keep the sections firmly engaged with each other.

Figure 7:
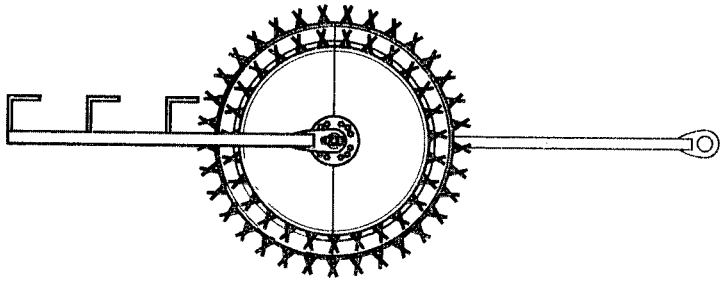
FIGS. 5, 6 and 7 are side, plan and end views respectively of a barrier according to the invention.
Figure 5:
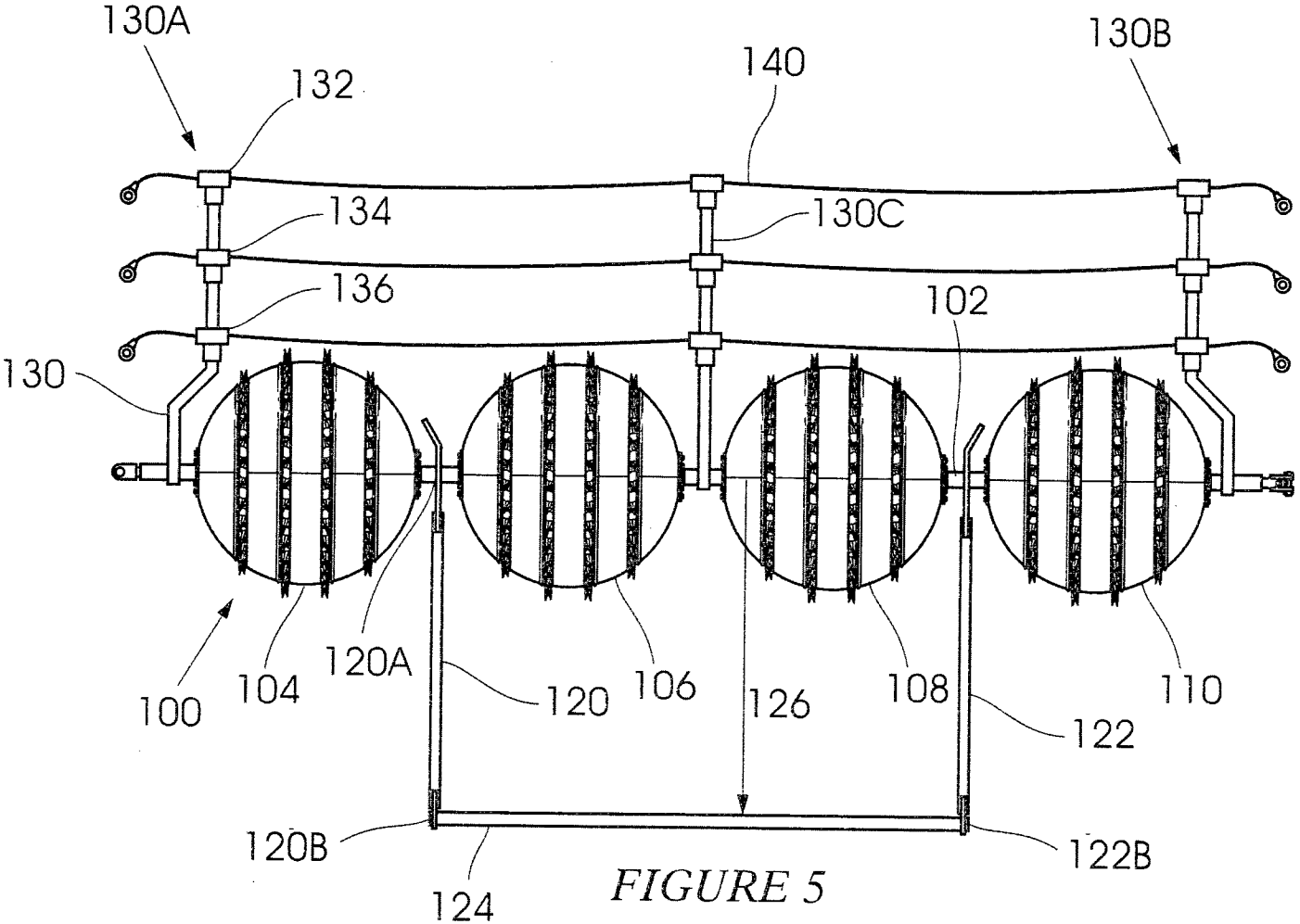
Figure 6:
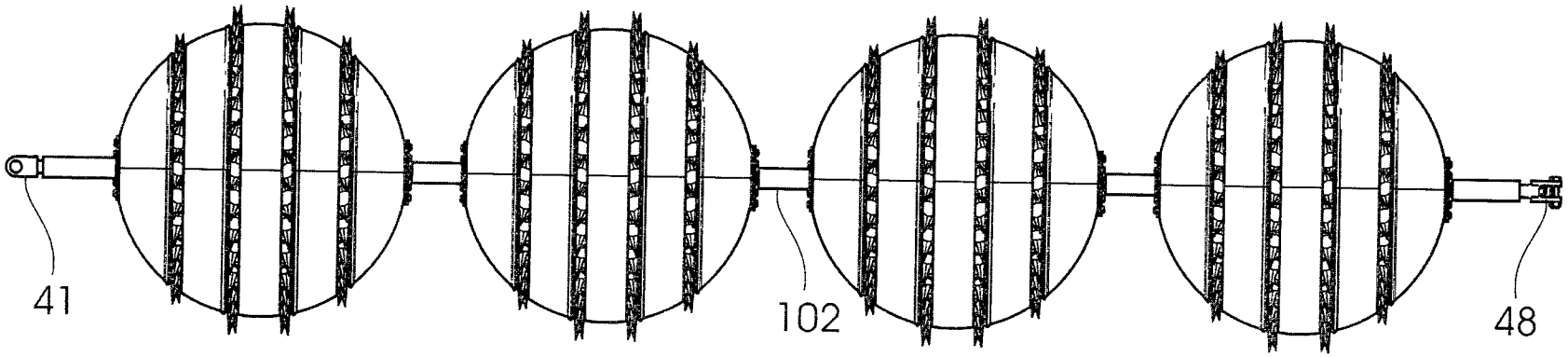

FIGS. 5, 6 and 7 are side, plan and end views respectively of a barrier 100 according to the invention. The barrier includes an elongate solid axle 102 on which four buoyant bodies 104, 106, 108 and 110 are mounted at evenly spaced locations. At opposed ends the axle has mounting structure in the form of universal-type shackle joints 112 and 114. Alternatively, short flexible chains or cables, between adjacent bodies, are connected to axles on which the respective bodies are mounted.

The buoyant bodies are substantially identical and are made in the manner which has been described hereinbefore. Each buoyant body is free to rotate about the axle. This is not necessarily the case for, in an alternative form of the invention, each buoyant body is fixed to the axle so that it is only rotatable together with the axle.

Elongate members 120 and 122 are positioned, respectively, between the bodies 104 and 106, and 108 and 122. The elongate member 120 has a first end 120A which is mounted to the axle between the bodies 104 and 106. Similarly the elongate member 122 is mounted to the axle between the bodies 108 and 110. An elongate counterweight 124 extends between, and is attached to, opposed respective second ends 120B and 122B of the elongate members. The counterweight is in the form of a chosen mass of desired magnitude which is positioned a fairly substantial distance 126 from the axle 102. The counterweight can be made in any suitable way. In one preferred form of construction the counterweight is a tube which is filled with a high density, settable material which is thereby encapsulated in the tube.

Elongate supports 130 are fixed to the axle and extend from the axle in a direction which is diametrically opposed to the position of the counterweight. Each elongate support is rigid. Each support carries three clamps 132, 134 and 136 respectively at spaced locations. First and second elongate supports 130A and 130B respectively, are positioned close to the respective ends of the axle while a third support 130C is positioned between the buoyant bodies 106 and 108. Strong, flexible, weather-resistant cables or chains 140 are fixed to the clamps and extend between the supports generally parallel to the axle. The cables are held by the supports on a side of the axle which is diametrically opposed to the counterweight, and form a transversely extending array which is positioned above the buoyant bodies.

The floating barrier offers substantial protection to an installation against attack by relatively small vessels. The counterweight acts to urge the buoyant bodies to an orientation in which the elongate supports extend upwardly and the cables or chains carried by the supports are thereby elevated. If an attempt is made to propel a boat over the floating barrier the elevated cables help to trap the boat and impede its movement.

Secondly, if a barrier is rotated by an impacting boat, the action of the counterweight is such as to restore the barrier, fairly quickly, to a desired orientation at which the cables which it carries are again elevated.

The deterrent formations on the outer surface of each respective buoyant body can penetrate a hull of a boat and can become locked to the hull. This also helps to impede passage of the boat.

The two-part construction of the buoyant body simplifies manufacturing procedures, for it can readily be ascertained that the interior of each shell 14 has been correctly filled with the marine foam 18. Maintenance is also simplified for, if required, a buoyant body can be replaced.

The counterweight 124 is supported by four of the buoyant bodies. Its mass can therefore be greater than the mass of a counterweight which is supported by only one buoyant body. Also, a force which is required to rotate the counterweight rapidly so that an impacting boat can travel over the barrier is considerably increased. The cables 140 interconnect four of the buoys on one axle and the impacting force on the cables must thus be sufficient to overcome the effect of one counterweight. The counterweight is displaced a substantial distance from the axis of the axle and consequently the moment required to rotate the counterweight about the axis is increased.

The floating barrier can be configured in different forms. The individual buoyant bodies could have smooth external surfaces. A physical barrier to movement of a vessel or a person is still presented but the likelihood that the buoyant bodies will cause damage to the vessel or injure a person is much reduced. If a formidable physical deterrent is required then the deterrent formations could be in the form of large and sharp spikes. The invention is not limited in this respect. Buoyant bodies with smooth surfaces can be used in a first array positioned on one side of a second array of buoyant bodies which carry spikes so that the deterrent effect of the resulting barrier is increased from one side to the other.

A plurality of the barriers 100 can be interconnected, to follow an elongate path. Each barrier is, in effect, a substantially rigid sub-assembly. However, adjacent barriers can move relative to one another because of flexible and articulated links which are established by interconnecting adjacent universal shackles 46, 48 to each other.

The invention claimed is:

1. A barrier comprising:

an elongate axle which, in use, is generally horizontal;

a first elongate member with a first end and an opposed second end, which is attached at the first end to the axle at a first location and which, in use, extends downwardly into water;

a second elongate member with a first end and an opposed second end, which is attached at the first end to the axle at a second location which is spaced from the first location, and which, in use, extends downwardly into the water;

at least one counterweight attached to respective second ends of the elongate members and which, in use, is immersed in the water;

at least first and second elongate supports attached to the axle and in which, in use, extend from the axle generally upwardly; and at least first and second buoyant bodies mounted at spaced locations to the axle, wherein at least one of the first and second buoyant bodies is positioned between said first and second locations;

a plurality of elongate flexible retaining members attached to the first and second elongate supports and which, in use, extend above the buoyant bodies, wherein each buoyant body is formed from two separately constructed halves which are interconnected to form the body and the axle extends between the interconnected halves of the body and wherein the bodies are rotatable relative to the elongate members and to the elongate supports.

2. The barrier according to claim 1, wherein each buoyant body comprises a plurality of spiked deterrent formations on an outer surface.

3. The barrier according to claim 1, wherein the first and second buoyant bodies are mounted at spaced locations to the axle between the elongate members, and wherein the barrier includes third and fourth buoyant bodies mounted to the axle near respective opposed ends of the axle.

4. The barrier according to claim 1, further comprising at each end of the axle a respective universal coupling which allows the axle to rotate and to move transversely, to a limited extent, relative to a longitudinal axis.

5. The barrier according to claim 1, wherein each buoyant body is rotatable about, and relative to, the axle.

6. The barrier according to claim 1, wherein each buoyant body is fixed to the axle so that it is rotatable together with the axle.

7. A barrier assembly comprising a plurality of barriers, wherein each barrier is according to claim 1, and wherein the barriers are connected to one another in an elongate array.

8. The barrier according to claim 1, wherein the axle further comprises a tube and a shaft which extends through the tube, wherein each buoyant body includes a respective pair of flanges which are fixed to the tube and which are fixed to opposed side of the buoyant body.

* * * * *